US009281562B2

(12) United States Patent
Karkinen et al.

(10) Patent No.: US 9,281,562 B2
(45) Date of Patent: Mar. 8, 2016

(54) APPARATUS WITH ANTENNA AND METHOD FOR WIRELESS COMMUNICATION

(75) Inventors: Jouni Vesa Juhani Karkinen, Oulu (FI); Marko Tapio Autti, Oulu (FI)

(73) Assignee: Nokia Technologies Oy, Espoo (FI)

( * ) Notice: Subject to any disclaimer, the term of this patent is extended or adjusted under 35 U.S.C. 154(b) by 205 days.

(21) Appl. No.: 14/130,980

(22) PCT Filed: Jul. 6, 2011

(86) PCT No.: PCT/IB2011/053002

§ 371 (c)(1),
(2), (4) Date: Jan. 6, 2014

(87) PCT Pub. No.: WO2013/005080

PCT Pub. Date: Jan. 10, 2013

(65) Prior Publication Data

US 2014/0152522 A1 Jun. 5, 2014

(51) Int. Cl.

| | |
|---|---|
| ***H01Q 5/00*** | (2015.01) |
| ***H01Q 7/00*** | (2006.01) |
| ***H01Q 5/35*** | (2015.01) |
| ***H01Q 5/50*** | (2015.01) |
| ***H01Q 5/335*** | (2015.01) |

(52) U.S. Cl.

CPC ..... *H01Q 5/0093* (2013.01); *H01Q 5/335* (2015.01); *H01Q 5/35* (2015.01); *H01Q 5/50* (2015.01); *H01Q 7/00* (2013.01)

(58) Field of Classification Search

CPC ..... H01Q 5/335; H01Q 5/35; H01Q 5/50; H01Q 5/314

USPC ..... 343/803, 852

See application file for complete search history.

(56) References Cited

U.S. PATENT DOCUMENTS

| | | | | |
|---|---|---|---|---|
| 7,102,586 | B2 | 9/2006 | Liang et al. | 343/795 |
| 7,760,150 | B2 | 7/2010 | Sato | 343/724 |
| 8,629,813 | B2 * | 1/2014 | Milosavljevic | H01Q 1/243 343/850 |
| 2005/0119026 | A1 | 6/2005 | Harano | 455/556.1 |
| 2008/0106476 | A1 | 5/2008 | Tran et al. | 343/702 |

(Continued)

FOREIGN PATENT DOCUMENTS

| | | | |
|---|---|---|---|
| CN | 1622480 | A | 6/2005 |
| CN | 101809813 | A | 8/2010 |

(Continued)

OTHER PUBLICATIONS

Mak, Angus C.K., et al., "Reconfigurable Multiband Antenna Designs for Wireless Communication Devices", IEEE Transactions on Antennas and Propagation, vol. 55. No. 7, Jul. 2007, 9 pgs.

*Primary Examiner* — Hoang V Nguyen

(74) *Attorney, Agent, or Firm* — Harrington & Smith

(57) ABSTRACT

An apparatus including a first port configured to couple to a first location on an antenna; a second port configured to couple to a second location on the antenna; a switch configured to switch between a first electrical configuration in which the first port is coupled to radio circuitry, and a second electrical configuration in which the second port is coupled to the radio circuitry; first reactive circuitry configured to impedance match the antenna with the radio circuitry at a first operational resonant frequency band; and second reactive circuitry, different to the first reactive circuitry, and configured to impedance match the antenna with the radio circuitry at a second operational resonant frequency band, different to the first operational resonant frequency band.

19 Claims, 6 Drawing Sheets

(56) References Cited

U.S. PATENT DOCUMENTS

| | | | | |
|---|---|---|---|---|
| 2009/0128428 | A1 | 5/2009 | Ishizuka et al. | 343/702 |
| 2010/0279734 | A1 | 11/2010 | Karkinen et al. | 455/554.2 |
| 2011/0012792 | A1 | 1/2011 | Krenz et al. | 343/702 |
| 2011/0187615 | A1 * | 8/2011 | Sakata | H01Q 1/521 343/722 |

FOREIGN PATENT DOCUMENTS

| | | | |
|---|---|---|---|
| EP | 0 993 070 | A1 | 4/2000 |
| EP | 1 231 670 | A2 | 8/2002 |
| GB | 2472779 | A | 2/2011 |
| JP | S61 265905 | A | 11/1986 |
| JP | H10 190345 | A | 7/1998 |
| JP | 2010-119067 | | 5/2010 |
| WO | WO 2007/137504 | A1 | 12/2007 |
| WO | WO 2008/059106 | A1 | 5/2008 |
| WO | WO 2008/093154 | A1 | 8/2008 |
| WO | WO 2009/027579 | A1 | 3/2009 |
| WO | WO 2009/155966 | A1 | 12/2009 |
| WO | WO 2009/156564 | A1 | 12/2009 |
| WO | WO 2010/137280 | A1 | 12/2010 |

* cited by examiner

APPARATUS WITH ANTENNA AND METHOD FOR WIRELESS COMMUNICATION

TECHNOLOGICAL FIELD

Embodiments of the present invention relate to apparatus for wireless communication. In particular, they relate to apparatus for wireless communication in an electronic communication device.

BACKGROUND

Apparatus, such as portable electronic communication devices, usually include radio circuitry and one or more antennas for enabling the apparatus to communicate wirelessly with other apparatus. In recent years, there has been a trend for such apparatus to be operable in a plurality of different operational frequency bands. For example, US Long Term Evolution (LTE) has two separate frequency bands, 734 to 746 MHz and 869 to 894 MHz. However, achieving operation in such a plurality of different operational frequency bands may require a plurality of different antennas and this may result in the apparatus being relatively large.

It would therefore be desirable to provide an alternative apparatus.

BRIEF SUMMARY

According to various, but not necessarily all, embodiments of the invention there is provided an apparatus comprising: a first port configured to couple to a first location on an antenna; a second port configured to couple to a second location on the antenna; a switch configured to switch between a first electrical configuration in which the first port is coupled to radio circuitry, and a second electrical configuration in which the second port is coupled to the radio circuitry; first reactive circuitry configured to impedance match the antenna with the radio circuitry at a first operational resonant frequency band; and second reactive circuitry, different to the first reactive circuitry, and configured to impedance match the antenna with the radio circuitry at a second operational resonant frequency band, different to the first operational resonant frequency band.

The apparatus may be for wireless communication.

The radio circuitry may have an impedance at the first operational resonant frequency band and the first reactive circuitry may be configured to impedance match the antenna with the radio circuitry by bringing an impedance of the antenna at the first operational resonant frequency band towards the impedance of the radio circuitry at the first operational resonant frequency band.

The radio circuitry may have an impedance at the second operational resonant frequency band and the second reactive circuitry may be configured to impedance match the antenna with the radio circuitry by bringing an impedance of the antenna at the second operational resonant frequency band towards the impedance of the radio circuitry at the second operational resonant frequency band.

The switch may be configured to disconnect the second port from the radio circuitry in the first electrical configuration, and is configured to disconnect the first port from the radio circuitry in the second electrical configuration.

The switch may be connected between the radio circuitry and the first reactive circuitry and the second reactive circuitry.

The first reactive circuitry may be configured to ground the first port when the switch is in the second electrical configuration, and the second reactive circuitry may be configured to ground the second port when the switch is in the first electrical configuration.

The apparatus may further comprise an antenna including a continuous conductive track extending between a first end defining the first location and a second end defining the second location.

The antenna may be a loop antenna or a folded dipole antenna.

The apparatus may further comprise a processor configured to control the electrical configuration of the switch.

The first operational resonant frequency band may be a first Long Term Evolution (LTE) frequency band, and the second operational resonant frequency band may be a second Long Term Evolution (LTE) frequency band.

According to various, but not necessarily all, embodiments of the invention there is provided an electronic communication device comprising an apparatus as described in any of the preceding paragraphs.

According to various, but not necessarily all, embodiments of the invention there is provided a module comprising an apparatus as described in any of the preceding paragraphs.

According to various, but not necessarily all, embodiments of the invention there is provided a method comprising: providing a first port configured to couple to a first location on an antenna; providing a second port configured to couple to a second location on the antenna; providing a switch configured to switch between a first electrical configuration in which the first port is coupled to radio circuitry, and a second electrical configuration in which the second port is coupled to the radio circuitry; providing first reactive circuitry configured to impedance match the antenna with the radio circuitry at a first operational resonant frequency band; and providing second reactive circuitry, different to the first reactive circuitry, and configured to impedance match the antenna with the radio circuitry at a second operational resonant frequency band, different to the first operational resonant frequency band.

The radio circuitry may have an impedance at the first operational resonant frequency band and the first reactive circuitry may be configured to impedance match the antenna with the radio circuitry by bringing an impedance of the antenna at the first operational resonant frequency band towards the impedance of the radio circuitry at the first operational resonant frequency band.

The radio circuitry may have an impedance at the second operational resonant frequency band and the second reactive circuitry may be configured to impedance match the antenna with the radio circuitry by bringing an impedance of the antenna at the second operational resonant frequency band towards the impedance of the radio circuitry at the second operational resonant frequency band.

The switch may be configured to disconnect the second port from the radio circuitry in the first electrical configuration, and may be configured to disconnect the first port from the radio circuitry in the second electrical configuration.

The switch may be connected between the radio circuitry and the first reactive circuitry and the second reactive circuitry.

The first reactive circuitry may be configured to ground the first port when the switch is in the second electrical configuration, and the second reactive circuitry may be configured to ground the second port when the switch is in the first electrical configuration.

The method may further comprise providing an antenna including a continuous conductive track extending between a first end defining the first location and a second end defining the second location.

The antenna may be a loop antenna or a folded dipole antenna.

The method may further comprise providing a processor configured to control the electrical configuration of the switch.

The first operational resonant frequency band may be a first Long Term Evolution (LTE) frequency band, and the second operational resonant frequency band may be a second Long Term Evolution (LTE) frequency band.

BRIEF DESCRIPTION

For a better understanding of various examples of embodiments of the present invention reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

Figure 2:
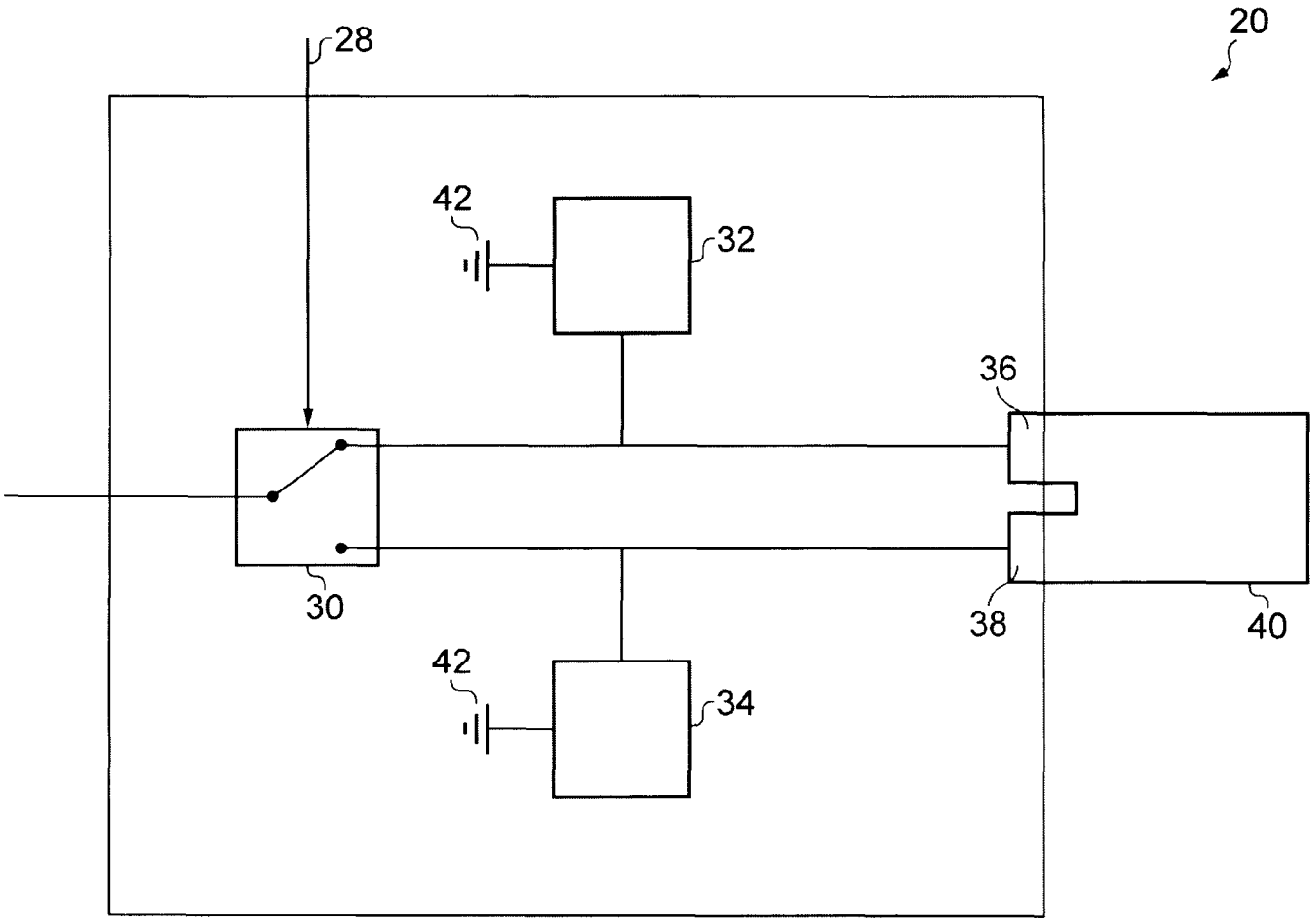
FIG. 2 illustrates a schematic diagram of an apparatus according to various embodiments of the invention.
Figure 3:
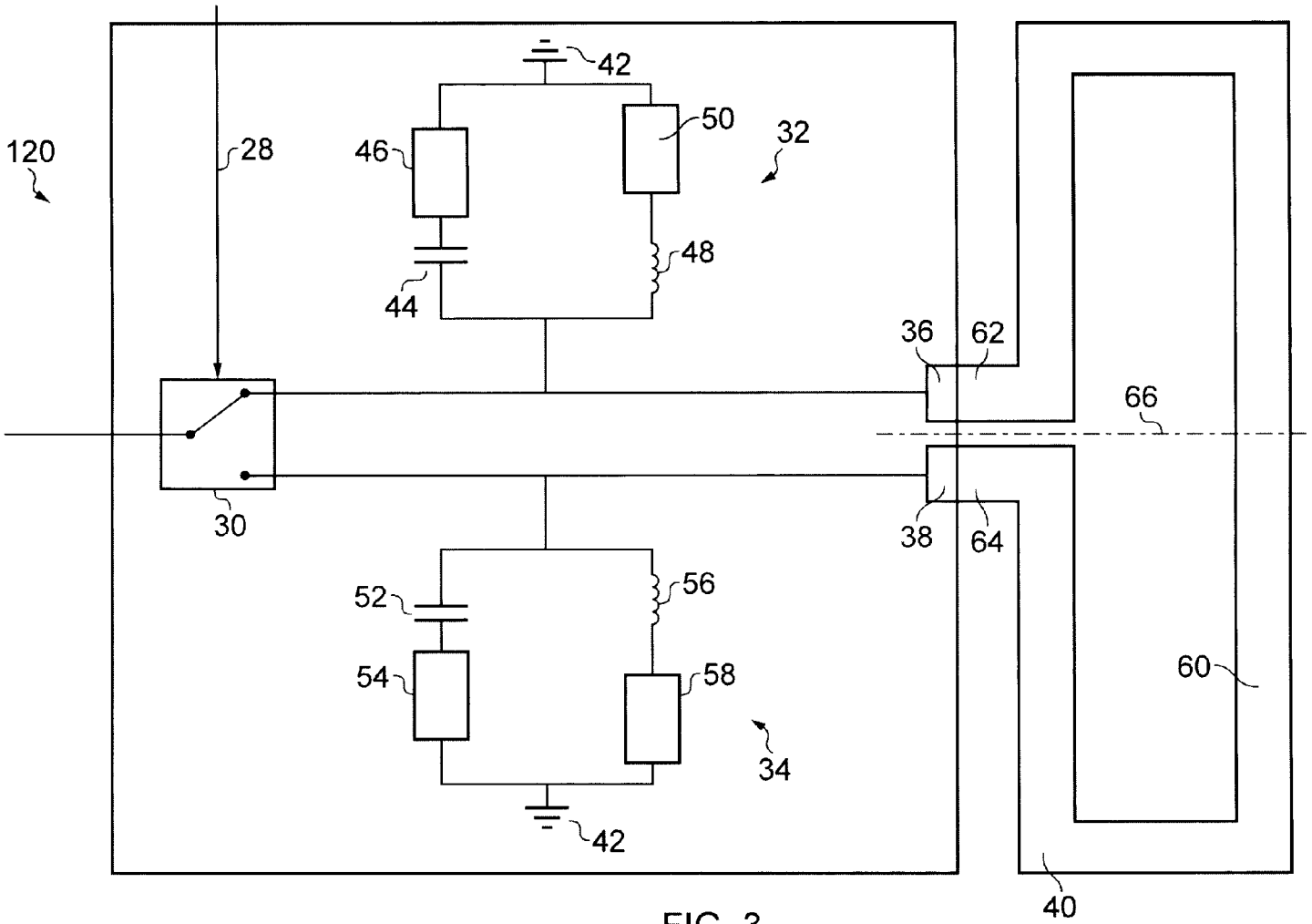
FIG. 3 illustrates a schematic diagram of another apparatus according to various embodiments of the invention.

FIGS. 2 and 3 illustrate an apparatus 20 comprising: a first port 36 configured to couple to a first location on an antenna 40; a second port 38 configured to couple to a second location on the antenna 40; a switch 30 configured to switch between a first electrical configuration in which the first port 36 is coupled to radio circuitry 18, and a second electrical configuration in which the second port 38 is coupled to the radio circuitry 18; first reactive circuitry 32 configured to impedance match the antenna 40 with the radio circuitry 18 at a first operational resonant frequency band; and second reactive circuitry 34, different to the first reactive circuitry 32, and configured to impedance match the antenna 40 with the radio circuitry 18 at a second operational resonant frequency band, different to the first operational resonant frequency band.

Figure 1:
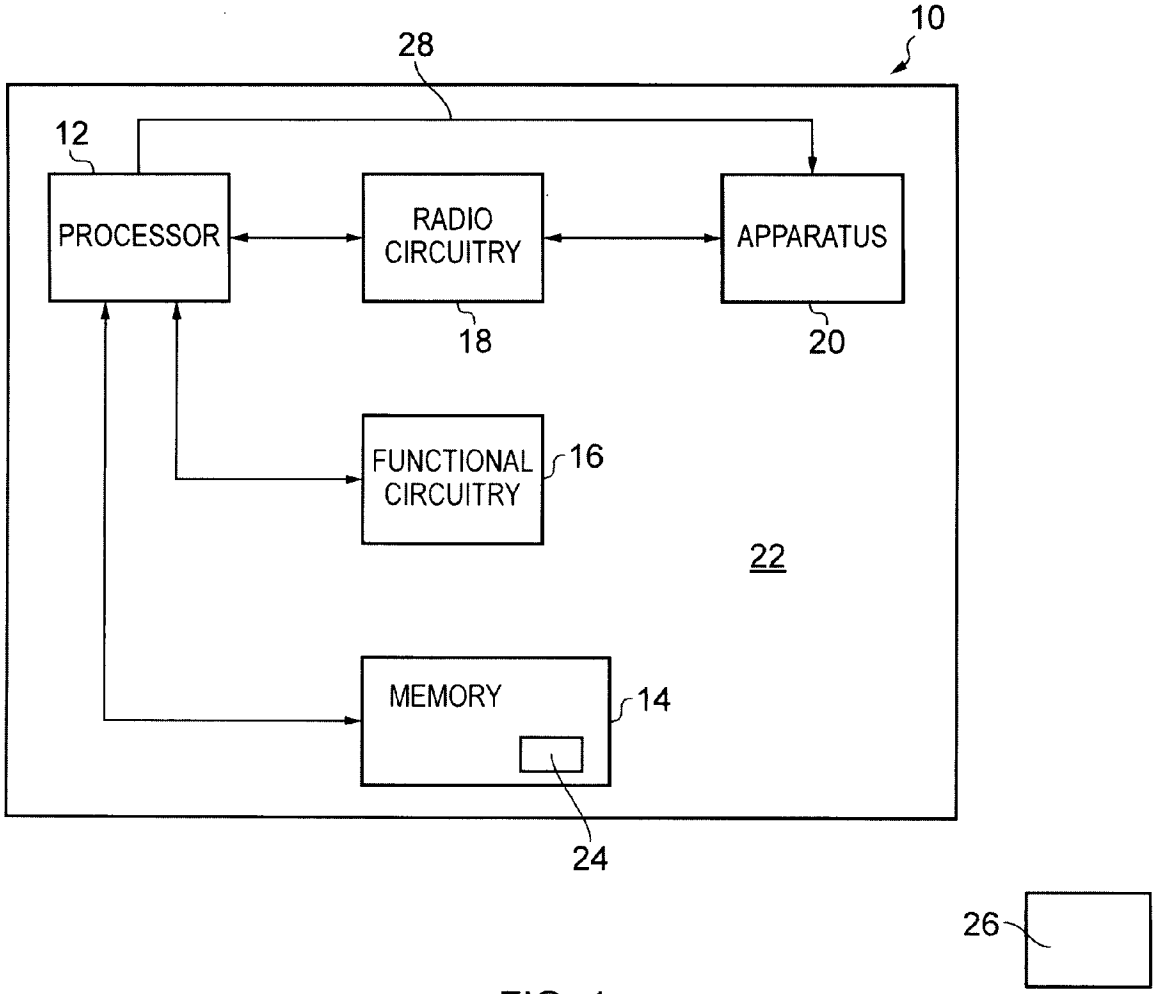
FIG. 1 illustrates a schematic diagram of a portable electronic communication device including an apparatus according to various embodiments of the invention.

In more detail, FIG. 1 illustrates an electronic communication device 10 which may be any apparatus such as a portable electronic communication device (for example, a mobile cellular telephone, a tablet computer, a laptop computer, a personal digital assistant or a hand held computer), a non-portable electronic device (for example, a personal computer or a base station for a cellular network), a portable multimedia device (for example, a music player, a video player, a game console and so on) or a module for such devices. As used here, 'module' refers to a unit or apparatus that excludes certain parts or components that would be added by an end manufacturer or a user.

The electronic communication device 10 comprises one or more processors 12, one or more memories 14, functional circuitry 16, radio circuitry 18, an apparatus 20 and a ground member 22.

The implementation of the processor 12 can be in hardware alone (for example, a circuit), have certain aspects in software including firmware alone or can be a combination of hardware and software (including firmware).

The processor 12 may be implemented using instructions that enable hardware functionality, for example, by using executable computer program instructions in a general-purpose or special-purpose processor that may be stored on a computer readable storage medium (disk, memory and so on) to be executed by such a processor.

The processor 12 is configured to read from and write to the memory 14. The processor 12 may also comprise an output interface via which data and/or commands are output by the processor 12 and an input interface via which data and/or commands are input to the processor 12.

The memory 14 may be any suitable memory and may be a hard disk drive or solid state memory for example. The memory 14 stores a computer program 24 comprising computer program instructions that control the operation of the apparatus 20 when loaded into the processor 12. The computer program instructions 24 provide the logic and routines that enables the apparatus 20 to perform the methods described in the following paragraphs. The processor 12 by reading the memory 14 is able to load and execute the computer program 24.

Although the memory 14 is illustrated as a single component it may be implemented as one or more separate components some or all of which may be integrated/removable and/or may provide permanent/semi-permanent/dynamic/cached storage.

The computer program may arrive at the electronic communication device 10 via any suitable delivery mechanism 26. The delivery mechanism 26 may be, for example, a computer-readable storage medium, a computer program product, a memory device, a record medium such as a compact disc read-only memory (CD-ROM) or digital versatile disc (DVD), an article of manufacture that tangibly embodies the computer program 24. The delivery mechanism may be a signal configured to reliably transfer the computer program 24. The electronic communication device 10 may propagate or transmit the computer program 24 as a computer data signal.

The functional circuitry 16 may comprise any additional circuitry or electronic components of the electronic communication device 10. For example, where the electronic communication device 10 is a portable electronic communication device (such as a mobile phone), the functional circuitry 16 may include input/output devices such as an audio input device (a microphone for example), an audio output device (a loudspeaker for example) and a display.

The processor 12 is configured to provide signals to, and/or receive signals from the radio circuitry 18. The radio circuitry 18 is connected between the processor 12 and the apparatus 20 and may include a receiver and/or a transmitter. The apparatus 20 is configured to transmit and receive, transmit only or receive only electromagnetic signals. The processor 12 is configured to provide a control signal 28 to the apparatus 20 and this is described in greater detail in the following paragraphs.

The radio circuitry 18 and the apparatus 20 are configured to operate in a plurality of operational resonant frequency bands and via one or more protocols. For example, the operational frequency bands and protocols may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an apparatus can efficiently operate using a protocol is a frequency range where the apparatus' return loss is less than an operational threshold. For example, efficient operation may occur when the apparatus' return loss is better than (that is, less than) −4 dB or −6 dB.

The processor 12, the memory 14, the functional circuitry 16, the radio circuitry 18, the apparatus 20 may be interconnected via the ground member 22 (for example, a printed wiring board). The ground member 22 may be used as a ground plane for the apparatus 20 by using one or more layers of the printed wiring board 22. In other embodiments, some other conductive part of the electronic communication device 10 (a battery cover for example) may be used as the ground member 22 for the apparatus 20. The ground member 22 may be formed from several conductive parts of the electronic communication device 10, for example and not limited to the printed wiring board, a conductive battery cover, and/or at least a portion of an external conductive casing or housing of the electronic communication device 10. The ground member 22 may be planar or non-planar.

FIG. 2 illustrates a schematic diagram of an apparatus 20 according to various embodiments of the invention. The apparatus 20 includes a switch 30, first reactive circuitry 32, second reactive circuitry 34, a first port 36, a second port 38, and an antenna 40.

The switch 30 may be any suitable switch and may be a field effect transistor (FET), a bipolar transistor, or a micro electro mechanical system (MEMs) switch. The switch 30 is connected between the radio circuitry 18, the first port 36 and the second port 38.

The switch 30 is configured to switch between a first electrical configuration in which the first port 36 is coupled to the radio circuitry 18 (as illustrated in FIG. 2), and a second electrical configuration in which the second port 38 is coupled to the radio circuitry 18. In more detail, when the switch 30 is in the first electrical configuration, the switch 30 connects the first port 36 to the radio circuitry 18 and disconnects the second port 38 from the radio circuitry 18. When the switch 30 is in the second electrical configuration, the switch 30 connects the second port 38 to the radio circuitry 18 and disconnects the first port 36 from the radio circuitry 18.

The first reactive circuitry 32 may comprise any suitable reactive components and may include capacitors and/or inductors and/or resistive components. The first reactive circuitry 32 is connected between the switch 30, the first port 36 and ground 42.

The second reactive circuitry 34 may comprise any suitable reactive components and may include capacitors and/or inductors and/or resistive components. The second reactive circuitry 34 is connected between the switch 30, the second port 38 and ground 42.

The first port 36 and the second port 38 are configured to couple to two different locations (first and second locations respectively) on the antenna 40. In some embodiments, the first port 36 and the second port 38 may be specially configured to connect to the antenna 40 and may include connectors such as connector sockets for receiving connector pins on the antenna 40. In other embodiments, the first port 36 and the second port 38 may not be specially configured to connect to the antenna 40 and are consequently, suitable for connection to the antenna 40 (via solder for example).

The antenna 40 may be any suitable antenna and may be, for example, a loop antenna, a folded dipole antenna, a patch antenna, a planar inverted F antenna (PIFA), an inverted F antenna (IFA), or any antenna type which may be coupled to radio circuitry from at least two locations on the radiating element.

The first reactive circuitry 32 is configured to impedance match the antenna 40 with the radio circuitry 18 at a first operational resonant frequency band. In more detail, the radio circuitry 18 has an impedance at the first operational resonant frequency band (such as fifty ohms) and the reactive components of the first reactive circuitry 32 are selected so that they impedance match the antenna 40 with the radio circuitry 18 by bringing the impedance of the antenna 40 at the first operational resonant frequency band towards the impedance of the radio circuitry 18 (that is, towards or equal to fifty ohms).

The second reactive circuitry 34 is configured to impedance match the antenna 40 with the radio circuitry 18 at a second operational resonant frequency band which is different to the first operational resonant frequency band. In some embodiments, the first and second operational resonant frequency bands may partially overlap, and in other embodiments, they may not overlap at all.

In more detail, the radio circuitry 18 has an impedance at the second operational resonant frequency band (such as fifty ohms) and the reactive components of the second reactive circuitry 34 are selected so that they impedance match the antenna 40 with the radio circuitry 18 by bringing the impedance of the antenna 40 at the second operational resonant frequency band towards the impedance of the radio circuitry 18 at the second operational resonant frequency band (that is, towards or equal to fifty ohms).

In operation, the processor 12 may determine that wireless communication in the first operational resonant frequency band is required. The processor 12 then provides the control signal 28 to the apparatus 20 so that the switch 30 is switched to (or maintained in) the first electrical configuration and the first port 36 is therefore coupled to the radio circuitry 18. Since the first reactive circuitry 32 impedance matches the antenna 40 to the radio circuitry 18 at the first operational resonant frequency band, the electronic communication device 10 may efficiently receive and/or transmit electromagnetic waves in the first operational resonant frequency band.

It should be appreciated that since the antenna 40 is coupled to ground 42 via the second reactive circuitry 34 and the second port 38, the second reactive circuitry 34 now functions as a loading component for the antenna 40 in the first electrical configuration. By "loading" we mean that the antenna has some additional reactive impedance between the antenna radiating element and the ground plane which causes at least one of the antenna resonance and the antenna bandwidth to be altered.

The processor 12 may also determine in operation that wireless communication in the second operational resonant frequency band is required. The processor 12 then provides the control signal 28 to the apparatus 20 so that the switch 30 is switched to (or maintained in) the second electrical configuration and the second port 38 is therefore coupled to the radio circuitry 18. Since the second reactive circuitry 34 impedance matches the antenna 40 to the radio circuitry 18 at the second operational resonant frequency band, the electronic communication device 10 may efficiently receive and/or transmit electromagnetic waves in the second operational resonant frequency band.

It should be appreciated that since the antenna 40 is coupled to ground 42 via the first reactive circuitry 32 and the first port 36, the first reactive circuitry 32 now functions as a loading component for the antenna 40 in the second electrical configuration.

Various embodiments of the invention may provide several advantages. For example, since the apparatus 20 is configured to enable a single antenna to operate in the first and second operational resonant frequency bands, the electronic communication device 10 does not require two separate antennas to cover these resonant frequency bands and may therefore be relatively small or have space for other antennas and/or electronic components.

Additionally, due to the location of the switch 30, the switch 30 introduces a negligible return loss to the apparatus 20. This may advantageously enable the electronic communication device 10 to communicate efficiently in the first and second operational resonant frequency bands.

FIG. 3 illustrates a schematic diagram of another apparatus 120 according to various embodiments of the invention. The apparatus 120 is similar to the apparatus 20 illustrated in FIG. 2 and where the features are similar, the same reference numerals are used.

The first reactive circuitry 32 includes a first capacitor 44, a first resistor 46, a first inductor 48 and a second resistor 50. The first capacitor 44 and the first resistor 46 are in an electrical parallel arrangement with the first inductor 48 and the second resistor 50. In this embodiment, the first capacitor 44 has a capacitance of 5 pF, the first resistor 46 has a resistance of 0.15 ohms, the first inductor 48 has an inductance of 15 nH and the second resistor 50 has a resistance of 0.9 ohms.

The second reactive circuitry 34 includes a second capacitor 52, a third resistor 54, a second inductor 56 and a fourth resistor 58. The second capacitor 52 and the third resistor 54 are in an electrical parallel arrangement with the second inductor 56 and the fourth resistor 58. In this embodiment, the second capacitor 52 has a capacitance of 3 pF, the third resistor 54 has a resistance of 0.15 ohms, the second inductor 56 has an inductance of 13 nH and the fourth resistor 58 has a resistance of 0.85 ohms.

The antenna 40 includes a single continuous conductive track 60 that extends between a first end 62 and a second end 64 and has a loop like structure. The first end 62 of the antenna 40 is connected to the first port 36 and the second end 64 of the antenna 40 is connected to the second port 38. In this embodiment, the antenna 40 is substantially symmetrical about a line 66 that runs between the first end 62 and the second end 64. In other embodiments the antenna 40 may be asymmetrical about the line 66. In other embodiments, where the antenna 40 is without clearly defined first and second ends, for example a square patch antenna or a circular patch antenna; a first part of the antenna 40 may be connected to the first port 36 and a second part of the antenna 40 may be connected to the second port 38. There may be only a small physical distance between the first and second parts in the order of a few millimeters or there may be a large physical distance between the first and second parts in the order of tens of millimeters. At least one additional ground point may also be included between the antenna 40 and the ground plane.

Figure 4:
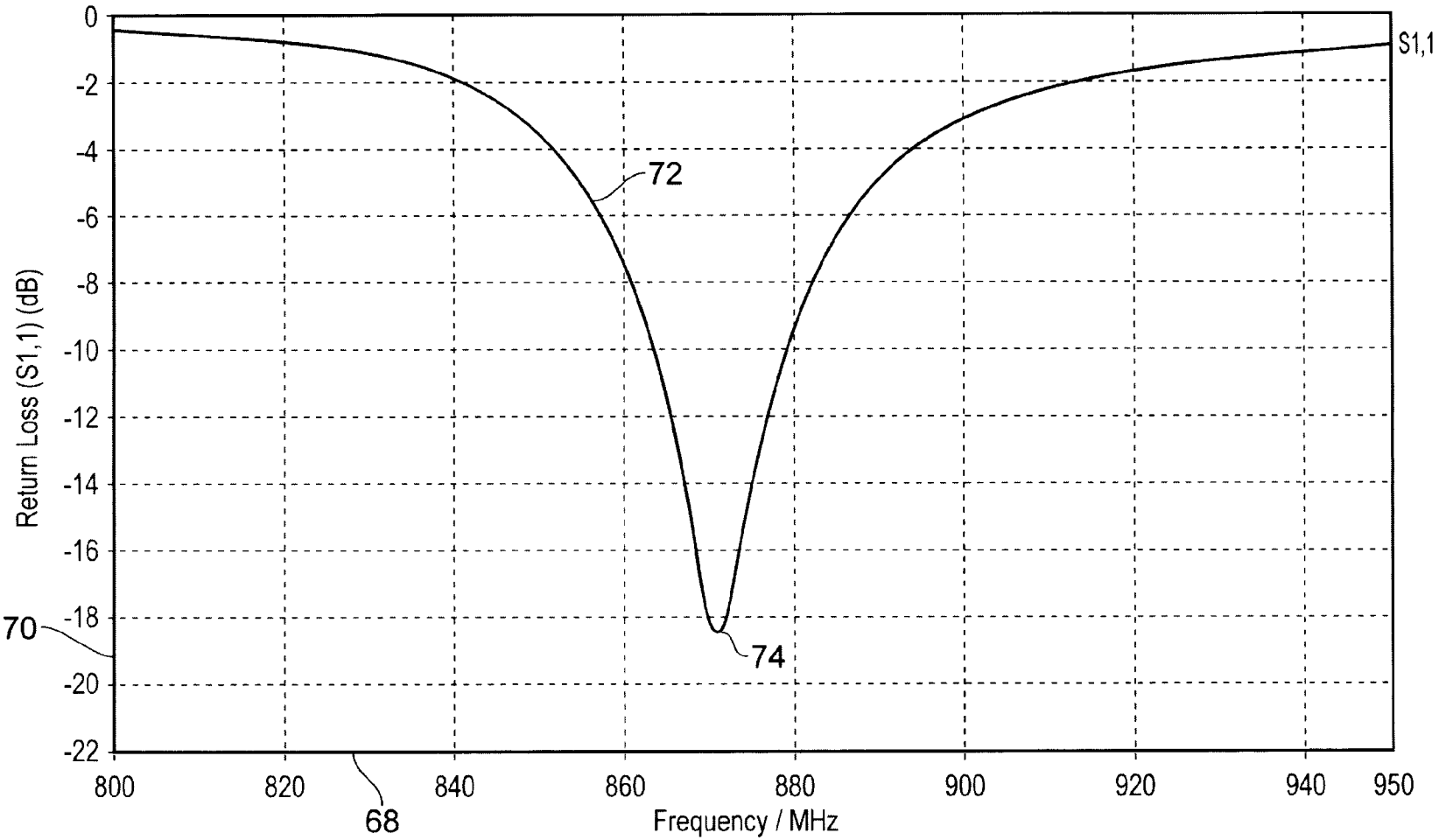
FIG. 4 illustrates a graph of return loss versus frequency for the apparatus illustrated in FIG. 3.

FIG. 4 illustrates a graph of return loss versus frequency of the apparatus 120 illustrated in FIG. 3 when the switch 30 is in the first electrical configuration. The graph includes a horizontal axis 68 that represents frequency (in MHz), a vertical axis 70 that represents return loss (in dB) and a trace 72 that represents how the return loss of the apparatus 120 varies with changing operating frequency.

At 800 MHz, the trace 72 has a return loss of approximately −0.4 dB. The trace 72 then has an increasingly negative gradient with increasing frequency until a minima 74 at a frequency of approximately 870 MHz and a return loss of approximately −18.5 dB. The trace 72 then has a decreasingly positive gradient and has a return loss of approximately −1 dB at 950 MHz. The frequency bandwidth of the apparatus 120 at −4 dB or below when the switch 30 is in the first electrical configuration is approximately 43 Mhz, from 851 MHz to 894 MHz. Consequently, the apparatus 120 in the first electrical configuration is advantageously configured to operate efficiently in the Long Term Evolution US frequency band of 869 MHz to 894 MHz.

Figure 5:
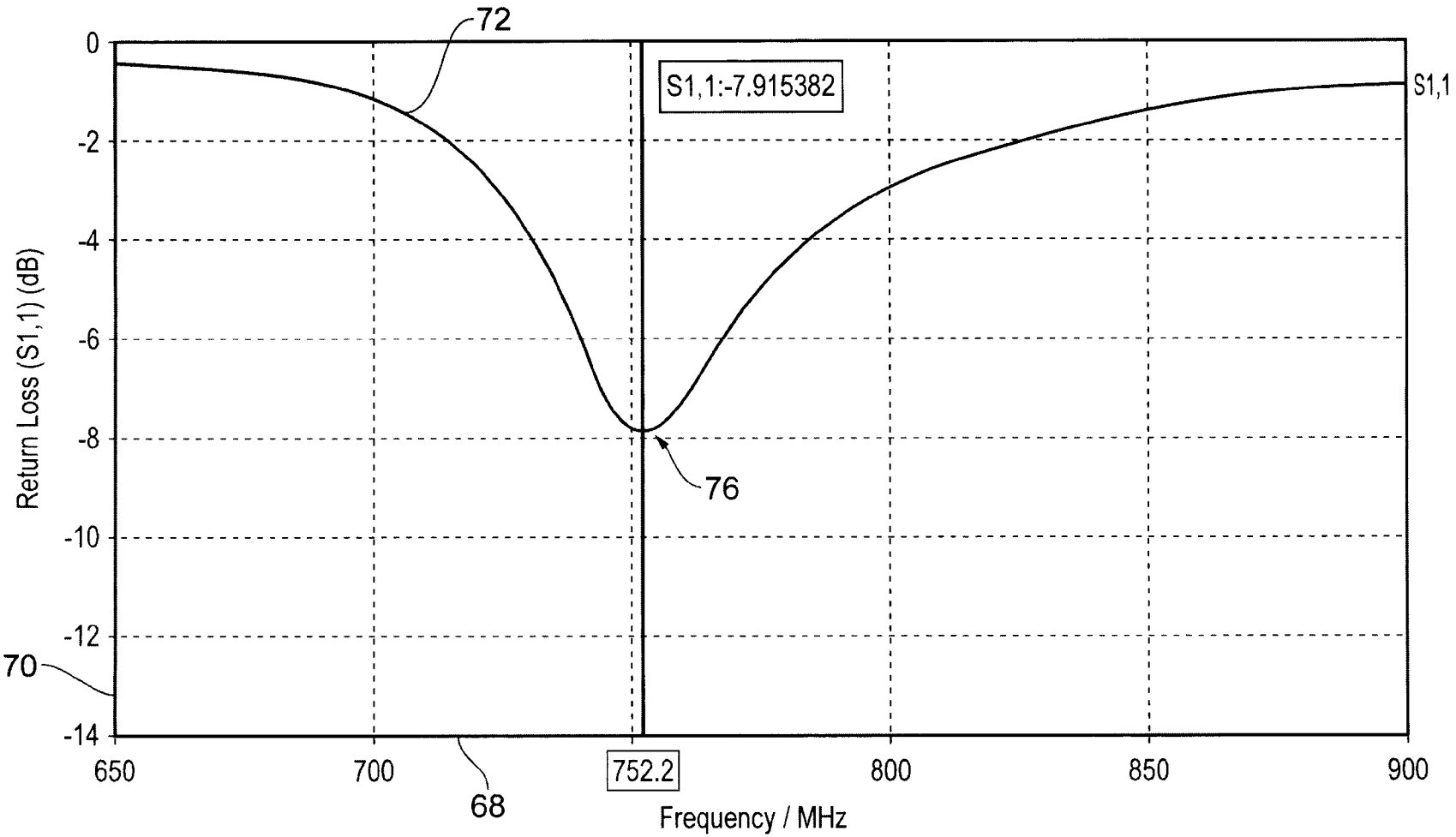
FIG. 5 illustrates another graph of return loss versus frequency for the apparatus illustrated in FIG. 3.

FIG. 5 illustrates a graph of return loss versus frequency of the apparatus 120 illustrated in FIG. 3 when the switch 30 is in the second electrical configuration. The graph illustrated in FIG. 5 is similar to the graph illustrated in FIG. 4, and where the features are similar, the same reference numerals are used.

At 650 MHz, the trace 72 has a return loss of approximately −0.5 dB. The trace 72 then has an increasingly negative gradient with increasing frequency until a minima 76 at a frequency of approximately 752 MHz and a return loss of approximately −7.9 dB. The trace 72 then has a decreasingly positive gradient and has a return loss of approximately −1 dB at 900 MHz. The frequency bandwidth of the apparatus 120 at −4 dB or below when the switch 30 is in the second electrical configuration is approximately 54 MHz, from 730 MHz to 784 MHz. Consequently, the apparatus 120 in the second electrical configuration is advantageously configured to operate efficiently in the Long Term Evolution US frequency band of 734 MHz to 746 MHz.

Figure 6:
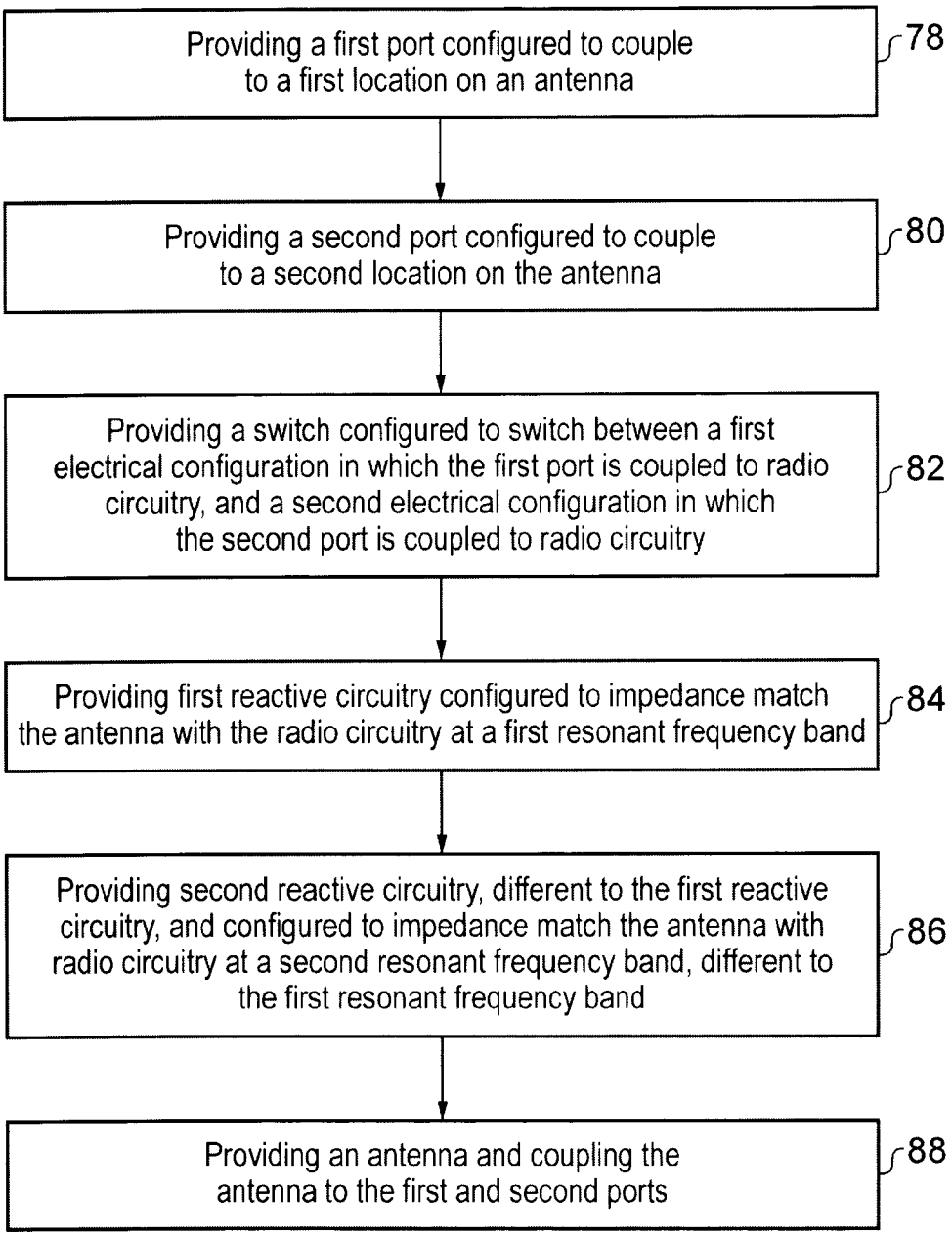
FIG. 6 illustrates a flow diagram of a method of manufacturing an apparatus according to various embodiments.

FIG. 6 illustrates a flow diagram of a method of manufacturing an apparatus 20, 120 according to various embodiments of the invention. It should be appreciated that the method may be performed manually by a human or may be performed automatically via one or more machines.

At block 78, the method includes providing a first port 36 that is configured to couple to a first location on an antenna 40.

At block 80, the method includes providing a second port 38 that is configured to couple to a second location on the antenna 40.

At block 82, the method includes providing a switch 30 and configuring the switch 30 so that it may switch between coupling the first port 36 to the radio circuitry 18 and coupling the second port 38 to the radio circuitry 18.

At block 84, the method includes providing first reactive circuitry 32 that is configured to impedance match the antenna 40 with the radio circuitry 18 at a first operational resonant frequency band.

At block 86, the method includes providing second reactive circuitry 34 that is configured to impedance match the antenna 40 with the radio circuitry 18 at a second operational resonant frequency band.

At block 88, the method includes providing the antenna 40 and may also include coupling the antenna 40 to the first port 36 and to the second port 38.

References to 'computer-readable storage medium', 'computer program product', 'tangibly embodied computer program' and so on or a 'controller', 'computer', 'processor' and so on should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code and so on should be understood to encompass software for a programmable processor or firmware such as, for example, the programmable content of a hardware device whether instructions for a processor, or configuration settings for a fixed-function device, gate array or programmable logic device and so on.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

The blocks illustrated in the FIG. 6 may represent steps in a method and/or sections of code in a computer program. For example, a processor may execute the computer program to control machinery to perform the method illustrated in FIG. 6 and thereby manufacture an apparatus 20, 120. The illustration of a particular order to the blocks does not necessarily imply that there is a required or preferred order for the blocks and the order and arrangement of the block may be varied. Furthermore, it may be possible for some blocks to be omitted. For example, blocks 78, 80, 82, 84, 86 and 88 may be performed in any order. However, where block 88 includes coupling the antenna 40 to the first port 36 and to the second port 38, block 88 is performed after blocks 78 and 80.

Although embodiments of the present invention have been described in the preceding paragraphs with reference to various examples, it should be appreciated that modifications to the examples given can be made without departing from the scope of the invention as claimed. For example, the first reactive circuitry 32 and/or the second reactive circuitry 34 may include one or more variable reactive components (such as a variable capacitor) that may be controlled by the processor 12 to alter the impedance matching provided by the first reactive circuitry 32 and/or the second reactive circuitry 34.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus comprising:

a first port configured to couple to a first location on an antenna;

a second port configured to couple to a second location on the antenna;

a switch configured to switch between a first electrical configuration in which the first port is coupled to radio circuitry, and a second electrical configuration in which the second port is coupled to the radio circuitry;

first reactive circuitry configured to impedance match the antenna with the radio circuitry at a first operational resonant frequency band; and second reactive circuitry, different to the first reactive circuitry, and configured to impedance match the antenna with the radio circuitry at a second operational resonant frequency band, different to the first operational resonant frequency band, and wherein the first reactive circuitry is configured to ground the first port when the switch is in the second electrical configuration, and the second reactive circuitry is configured to ground the second port when the switch is in the first electrical configuration.

2. An apparatus as claimed in claim 1, wherein the radio circuitry has an impedance at the first operational resonant frequency band and the first reactive circuitry is configured to impedance match the antenna with the radio circuitry by bringing an impedance of the antenna at the first operational resonant frequency band towards the impedance of the radio circuitry at the first operational resonant frequency band.

3. An apparatus as claimed in claim 1, wherein the radio circuitry has an impedance at the second operational resonant frequency band and the second reactive circuitry is configured to impedance match the antenna with the radio circuitry by bringing an impedance of the antenna at the second operational resonant frequency band towards the impedance of the radio circuitry at the second operational resonant frequency band.

4. An apparatus as claimed in claim 1, wherein the switch is configured to disconnect the second port from the radio circuitry in the first electrical configuration, and is configured to disconnect the first port from the radio circuitry in the second electrical configuration.

5. An apparatus as claimed in claim 1, wherein the switch is connected between the radio circuitry and the first reactive circuitry and the second reactive circuitry.

6. An apparatus as claimed in claim 1, further comprising an antenna including a continuous conductive track extending between a first end defining the first location and a second end defining the second location.

7. An apparatus as claimed in claim 6, wherein the antenna is a loop antenna or a folded dipole antenna.

8. An apparatus as claimed in claim 1, further comprising a processor configured to control the electrical configuration of the switch.

9. An apparatus as claimed in claim 1, wherein the first operational resonant frequency band is a first Long Term Evolution (LTE) frequency band, and the second operational resonant frequency band is a second Long Term Evolution (LTE) frequency band.

10. An electronic communication device or a module comprising an apparatus as claimed in claim 1.

11. A method comprising:

providing a first port configured to couple to a first location on an antenna;

providing a second port configured to couple to a second location on the antenna;

providing a switch configured to switch between a first electrical configuration in which the first port is coupled to radio circuitry, and a second electrical configuration in which the second port is coupled to the radio circuitry;

providing first reactive circuitry configured to impedance match the antenna with the radio circuitry at a first operational resonant frequency band; and providing second reactive circuitry, different to the first reactive circuitry, and configured to impedance match the antenna with the radio circuitry at a second operational resonant frequency band, different to the first operational resonant frequency band, and wherein the first reactive circuitry is configured to ground the first port when the switch is in the second electrical configuration, and the second reactive circuitry is configured to ground the second port when the switch is in the first electrical configuration.

12. A method as claimed in claim 11, wherein the radio circuitry has an impedance at the first operational resonant frequency band and the first reactive circuitry is configured to impedance match the antenna with the radio circuitry by bringing an impedance of the antenna at the first operational resonant frequency band towards the impedance of the radio circuitry at the first operational resonant frequency band.

13. A method as claimed in claim 11, wherein the radio circuitry has an impedance at the second operational resonant frequency band and the second reactive circuitry is configured to impedance match the antenna with the radio circuitry by bringing an impedance of the antenna at the second operational resonant frequency band towards the impedance of the radio circuitry at the second operational resonant frequency band.

14. A method as claimed in claim 1, wherein the switch is configured to disconnect the second port from the radio circuitry in the first electrical configuration, and is configured to disconnect the first port from the radio circuitry in the second electrical configuration.

15. A method as claimed in claim 11, wherein the switch is connected between the radio circuitry and the first reactive circuitry and the second reactive circuitry.

16. A method as claimed in claim 11, further comprising providing an antenna including a continuous conductive track extending between a first end defining the first location and a second end defining the second location.

17. A method as claimed in claim 16, wherein the antenna is a loop antenna or a folded dipole antenna.

18. A method as claimed in claim 11, further comprising providing a processor configured to control the electrical configuration of the switch.

19. A method as claimed in claim 11, wherein the first operational resonant frequency band is a first Long Term Evolution (LTE) frequency band, and the second operational resonant frequency band is a second Long Term Evolution (LTE) frequency band.

* * * * *